United States Patent [19]

Rumbaugh et al.

[11] 4,446,843

[45] May 8, 1984

[54] ADAPTIVE DWELL IGNITION SYSTEM

[75] Inventors: Robert C. Rumbaugh; Robert B. Jarrett, both of Tempe, Ariz.

[73] Assignee: Motorola, Inc., Schaumburg, Ill.

[21] Appl. No.: 432,611

[22] Filed: Oct. 4, 1982

[51] Int. Cl.[3] ..... F02P 5/00

[52] U.S. Cl. ..... 123/609; 123/618; 123/644

[58] Field of Search ..... 123/609, 618, 644; 307/246

[56] References Cited

U.S. PATENT DOCUMENTS

| | | | |
|---|---|---|---|
| 3,378,698 | 4/1968 | Kadah | 307/246 |
| 4,064,415 | 12/1977 | Blackington | 123/644 |
| 4,117,819 | 10/1979 | Jarrett et al. | 123/609 |
| 4,170,209 | 10/1979 | Petrie et al. | 123/609 |
| 4,275,702 | 6/1981 | Jundt et al. | 123/644 |

*Primary Examiner*—Parshotam S. Lall
*Attorney, Agent, or Firm*—Michael D. Bingham

[57] ABSTRACT

An electronic ignition system which is responsive to timing signals generated in timed relationship for providing a substantially constant percent excess dwell time. The timing signals are developed across a sensor coil that is floated between first and second inputs of the system. A capacitor is coupled through a buffer circuit to one of the inputs of the system wherein the timing signal is superimposed onto the voltage developed across the capacitor. A charge and discharge circuit comprising a pair of resistive current sources is utilized to charge and discharge the capacitor during operation. The ratio of the resistive components produces a constant percent excess dwell time that is substantially independent to temperature and process variations.

5 Claims, 1 Drawing Figure

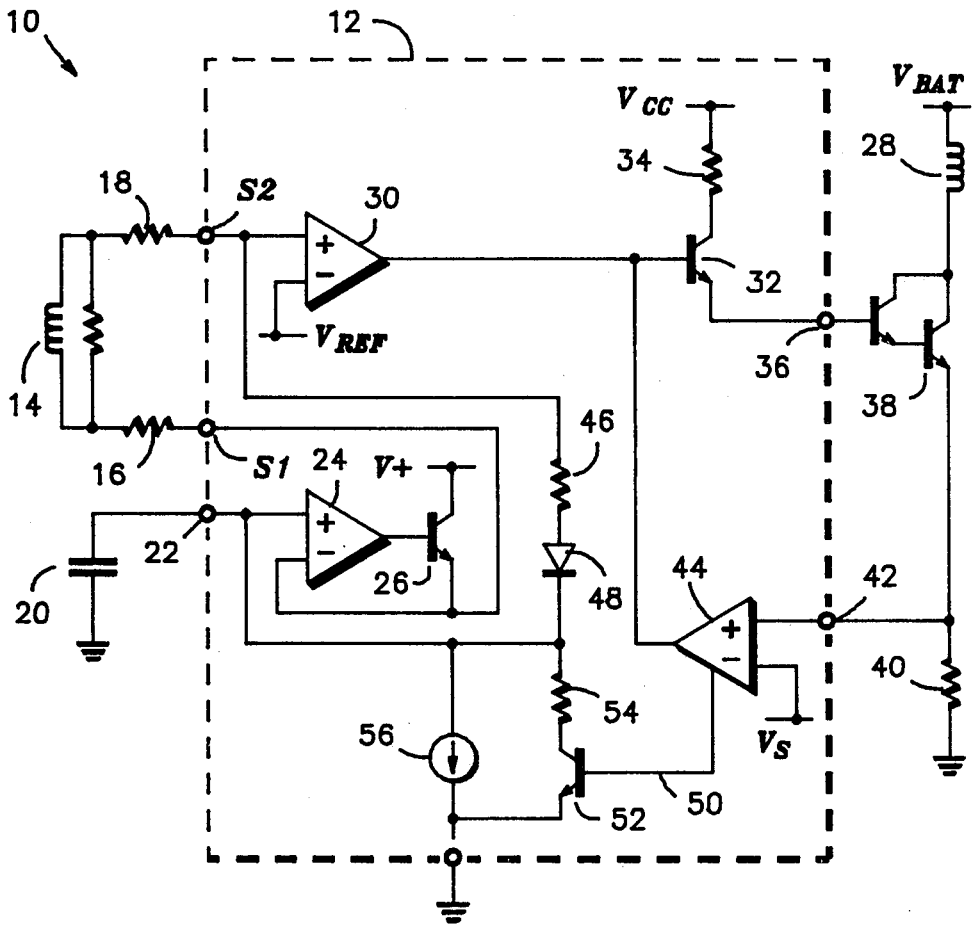
10
12
$V_{CC}$
$V_{BAT}$
34
28
18
S2
30
32
$V_{REF}$
36
38
14
46
16
S1
24
V+
22
26
48
44
42
20
40
54
56
$V_S$
52
50

ADAPTIVE DWELL IGNITION SYSTEM

BACKGROUND OF THE INVENTION

The present invention relates to solid state ignition systems and, more particularly, to an adaptive dwell ignition system wherein the excess dwell time is varied with engine rpm such that the excess dwell period is a constant percent time.

Adaptive dwell ignition systems are well known to those skilled in the art. For example, U.S. Pat. No. 4,117,819 discloses an adaptive dwell ignition system to which the subject invention is an improvement thereover. The ignition system of the aforereferenced patent comprises an adaptive dwell capacitor which is charged and discharged during a firing cycle. The capacitor is connected to one end of a sensor coil, at a first input of the ignition system, through a buffer amplifier of the ignition system. The other end of the sensor coil is connected to a second input of the ignition system. The second end of the sensor coil is also coupled to ground reference potential through a resistor divider circuit.

Briefly, timing signals are developed across the sensor coil in timed relationship to operation of the engine. The timing signals are superimposed onto the voltage appearing at the first end of the sensor coil, which voltage is essentially the voltage developed across the adaptive dwell capacitor. In response to the voltage developed at the second end of the sensor coil exceeding a reference potential the ignition system produces current to charge the primary of the ignition coil during the firing cycle. At a predetermined value the charging current is limited by regulating means of the ignition system. The portion of the firing cycle period during which the current is limited is typically referred to as the excess dwell time. At the end of the firing cycle the coil current is abruptly terminated which causes the field to collapse about the coil. This action produces spark to drive the engine.

In order to minimize power dissipation and to prevent mis-spark or no-spark conditions it is desirable to minimize the excess dwell time while ensuring adequate field energy. Thus, as the engine rpm is varied the time at which coil current is initiated in a firing cycle is varied. The manner in which this is done is by charging and discharging the adaptive dwell capacitor accordingly. This causes the reference level upon which the timing signal rides to change which in turn causes the coil current to be turned on either earlier or later in the cycle as is understood.

A problem with this prior art system is that the adaptive dwell capacitor is charged through the external resistor divider circuit whereas the discharge thereof is through a current source which is internal to the ignition system which is fabricated as a monolithic integrated circuit. Therefore, due to temperature and process variations, the ratio between the charge and discharge currents can vary. This will cause the excess dwell time at any particular engine rpm to vary which is undesirable.

Additionally, the external resistor divider circuit requires a third input to the integrated circuit. This means that an additional pin out is required.

Furthermore, the resistor divider circuit has closed loop currents flowing therethrough which necessarily requires small valued resistors to be used to maintain proper charging of the adaptive dwell capacitor but which limits protection of the integrated circuit to inductively and capacitively coupled voltage transients that may occur across the sensor coil.

In view of the above, it is desirous to have an adaptive dwell ignition system of the type described in which the excess dwell current is maintained a constant percent of time and is also independent of temperature and process variations. Moreover, it is desirable to eliminate as many pin out requirements for the integrated circuit as possible for cost reductions. Still further, it is desirable to eliminate external loop currents and to provide voltage transient protection to the ignition system.

SUMMARY OF THE INVENTION

Accordingly, it is an object of the present invention to provide an improved adaptive dwell ignition system.

It is another object of the present invention to provide an adaptive dwell ignition system the excess dwell current of which is maintained substantially a constant percent of time of the engine firing cycle period.

Still another object of the present invention is to provide an ignition system suited for fabrication in monolithic integrated circuit form which produces an excess dwell current that is a constant percent of time of an engine firing cycle period and is independent to temperature and process variations.

In accordance with the above and other objects there is provided an adaptive dwell ignition system for charging and discharging an ignition coil to generate spark to operate an engine including an adaptive dwell capacitor for varying the excess dwell time and an integrated circuit portion responsive to timing signals applied thereto which are superimposed onto the voltage potential developed across the adaptive dwell capacitor, the improvement comprising the integrated circuit portion including first resistive circuit means coupled between a first input of the ignition system and a first circuit node for charging the adaptive dwell capacitor and a second resistive circuit means for discharging the adaptive dwell capacitor during the excess dwell time, said second resistive circuit being coupled between said circuit node and a terminal at which is supplied a ground reference potential.

DESCRIPTION OF THE DRAWING

The sole FIGURE is a partial schematic and block diagram illustrating the ignition system of the preferred embodiment.

DETAILED DESCRIPTION OF THE PREFERRED EMBODIMENT

Turning now to the single FIGURE there is shown adaptive dwell ignition system 10 of the present invention. The portion of ignition system 10 enclosed within dashed outline 12 is suitable for manufacture in integrated circuit form. The basic operation of system 10 is generally known and understood by those skilled in the art and is described in detail in the aforereferenced U.S. Pat. No. 4,117,819.

Briefly, timing signals are generated in timed relationship to the operation of the automobile engine and are developed across reluctance sensor 14. These timing signals are generally modified sinusoidal form as understood. The timing signals are applied via resistors 16 and 18 to the S1 and S2 terminals respectively. An external adaptive dwell capacitor 20 is coupled to terminal 22 and through unity gain amplifier 24 and buffer transistor 26 to the S1 terminal. Hence, terminal S1 is maintained at substantially the same potential as the voltage developed across capacitor 20. The timing signals are superimposed or ride about the potential appearing at the S1 terminal: the voltage developed across capacitor 20. Thus, by varying the voltage on capacitor 20 the excess dwell time (the time that the current through the primary ignition coil 28 is limited) can be varied as will be explained hereinafter.

The signal appearing at the S2 terminal is applied to the non-inverting input of operational amplifier 30, the inverting input of which is coupled to a reference voltage Vref. Whenever the magnitude of the signal applied at terminal S2 exceeds Vref an output signal occurs at the output of operational amplifier 30 which renders transistor 32 conductive. Current drive is supplied from Vcc through resistor 34 and the collector-emitter path of transistor 32 to output 36. This turns on Darlington amplifier 38 to produce current flow through ignition coil 28 and sense resistor 40. Due to the finite impedance of coil 28, the current flowing therethrough ramps upward until a predetermined value is reached at which time a voltage is developed across resistor 40, and applied at terminal 42, that exceeds the reference voltage Vs. Thereafter the current through ignition coil 28 is limited or regulated by operational amplifier 44 linearly inhibiting additional drive current from being supplied by transistor 32 to Darlington amplifier 38.

The portion of each firing cycle, the period of each successive timing signal, during which the current flow through ignition coil is limited is referred to as the excess dwell time. As understood, by incorporating hysteresis into operational amplifier 30, at the end of each firing cycle when the timing signal decreases in a negative direction, a point is reached at which operational amplifier 30 turns off transistor 32. Hence, without sustaining current drive Darlington amplifier 38 turns off and the current through ignition coil 28 rapidly decreases to zero collapsing the field of the coil. This causes a spark to be generated in the engine.

It is important that the current through ignition coil 28 reach a maximum level prior to the end of each firing cycle to ensure that there is enough energy stored in the field to generate spark in the engine. However, in order to protect the Darlington amplifier and to prevent excessive drain on the car battery it is desired to limit the current through the coil at the value sufficient to cause engine firing. In addition, it is desired to vary the excess dwell with engine rpm so that at slower engine rpm the excess dwell time is not too long and at the highest engine rpm excess dwell is reached thereby ensuring engine firing. Otherwise, at low engine rpm excessive power may be dissipated that could eventually damage or even destroy the Darlington amplifier while at higher engine rpm's mis-spark or no spark conditions could occur.

In view of the above, adaptive dwell ignition systems such as described in the referenced '819 patent vary the time during the firing cycle at which Darlington amplifier 38 is turned on to start current ramping through ignition coil 28 at different engine rpm's.

The excess dwell time is varied at different engine speeds by varying the voltage developed across capacitor 20. This is accomplished by charging and discharging the capacitor appropriately during each firing cycle. For instance, at a constant engine rpm, as the magnitude of the timing signal exceeds the value of the voltage developed across the capacitor during the preceeding firing cycle current is allowed to flow therethrough to charge the same. In response to the current through the ignition coil being limited, the capacitor is discharged until the end of the firing cycle. At constant engine rpm the amount that the capacitor is charged equals the amount of discharge thereof. Thus, the voltage developed thereacross will remain substantially constant wherein operational amplifier 30, and therefore Darlington amplifier 38, are rendered operative at the same time in the firing cycle. If the engine rpm should, for example, decrease to a lower value, over a few cycles, capacitor 20 would be discharged longer than it is charged until at a new and lower constant engine rpm equilibrium is again reached. At this point, because the voltage across the capacitor is at a lower potential, the timing signal developed across the sensor coil and which is superimposed on the capacitor voltage does not exceed Vref until longer into the firing cycle with respect to higher rpm's. Hence, the excess dwell time is varied accordingly. Likewise, at higher engine rpm's the voltage developed across capacitor 20 is increased which in combination with larger magnitude timing signals that are developed across sensor coil 14 causes ignition coil current to flow earlier in the firing cycle respectively to ensure that excess dwell is reached prior to the end of the particular firing cycle. This operation is well known to those skilled in the art.

The problem with some of the prior art adaptive dwell ignition system of the type described above relates to the manner in which the adaptive dwell capacitor is charged and discharged. Typically, the capacitor is charged through an external resistive divider and is discharged by a current source internal to the integrated circuit. Thus, over temperature variations and processing the excess dwell time can vary which is not desirous.

In the preferred embodiment of the present invention capacitor 20 is charged during each firing cycle as the magnitude of the timing signal exceeds the voltage across the capacitor by one diode voltage drop. When this condition occurs, current flows through integrated resistor 46 and diode 48 to charge the capacitor. At current limiting, operational amplifier 44 produces a control signal, via lead 50, to render transistor 52 conductive to cause the discharge of capacitor 20 through internal resistor 54.

Because resistors 46 and 54 are monolithic resistors, the ratio therebetween can be matched such that over temperature and process variations the excess dwell time of the ignition system remains substantially constant and is a constant percentage of time of each firing cycle period, regardless of engine rpm. This is an advantage over prior art ignition systems of the type described above.

Another aspect of the present invention is that capacitor 20 is at all times discharged by a minimal amount through current source 56. In normal operation the effect of current source 56 can be neglected. However, without current source 56, under low battery conditions it is possible for the timing signal to charge capacitor 20 while producing coil current without causing the voltage developed across resistor 40 to exceed Vs due to series coil resistance. In this condition, capacitor 20 would not be discharged whereby the capacitor would be continually charged until operational amplifier 30 causes coil current to flow at all times. This condition is highly undesirable. Current source 56 prevents this condition from occurring by causing capacitor 20 to be discharged under low battery conditions to prevent successive charging of the capacitor without it being discharged.

Another advantage of the present invention over some prior art ignition systems results by floating sensor coil 14 between terminals S1 and S2 and directly charging capacitor 20 from the S2 terminal through resistor 46. As no external loop currents are required for charging capacitor 20 resistors 16 and 18 can have large values, for example, 20K ohms. Thus, integrated circuit 12 is protected from large voltage transients that otherwise may be developed either across sensor coil 14 or single endedly at each terminal thereof to ground.

Thus, what has been described above is a novel adaptive dwell ignition system for providing an excess dwell time that is a constant percent of the engine firing cycle. The ignition system includes protection circuit means to prohibit latch up of the system under low battery conditions which could otherwise cause excessive power drain through the ignition coil and mis-spark in the engine.

We claim:

1. An integrated adaptive dwell ignition system for charging and discharging an ignition coil to generate spark to operate an engine, the ignition system being responsive to timing signals developed across a sensing means coupled at first and second inputs thereof in timed relationship with operation of the engine, comprising:

circuit means responsive to the magnitude of the timing signals appearing at the first input exceeding a reference potential for producing drive current at an output of the system that is utilized to produce a charging current through the ignition coil;

regulator means responsive to the magnitude of said charging current exceeding a predetermined threshold value for causing said circuit means to limit the same thereat;

buffer means coupled between the second input and a third input of the ignition system at which is connected a charge storage device;

charge and discharge circuit means which is responsive to the timing signal appearing at the first input exceeding a threshold potential for charging said charge storage device and being responsive to said regulator means during the time that said charging current through the ignition coil is limited for discharging said charge storage device, said charge and discharge circuit means including first and second serially coupled resistors the ratio of which substantially determines the percent time that the charging current through the ignition coil is limited, said ratio being substantially independent of environmental variations to thereby maintain the ratio of the charging current to the discharging current constant at any given engine RPM.

2. The ignition system of claim 1 including additional discharge circuit means for continually discharging said charge storage device.

3. The ignition system of claim 2 wherein said circuit means includes an operational amplifier having first and second inputs and an output, said first input being coupled to the first input of the system and said second input receiving a reference potential, and a first transistor coupled between said output of said operational amplifier and said output of the system.

4. The ignition system of claim 3 wherein said charge and discharge circuit means includes said first resistor being series connected with a diode between said first input of said operational amplifier and a circuit node; and a second transistor having first and second electrodes series connected with said second resistor between a ground reference terminal and said circuit node, and a control electrode coupled to said regulator means such that said second transistor is rendered conductive by said regulator means to discharge said charge storage device.

5. In an adaptive dwell ignition system for charging and discharging an ignition coil to generate spark to operate an engine including an adaptive dwell capacitor for varying the excess dwell time and an integrated circuit portion responsive to timing signals applied thereto which are superimposed onto the voltage potential developed across the adaptive dwell capacitor, the improvement comprising the integrated circuit portion including first resistive circuit means coupled between a first input of the ignition system and a first circuit node for charging the adaptive dwell capacitor and a second resistive circuit means for discharging the adaptive dwell capacitor during the excess dwell time, said second resistive circuit means being coupled between said circuit node and a terminal at which is supplied a ground reference potential, the ratio between said charging and discharging of said adaptive capacitor being maintained constant at any given engine RPM to thereby maintain the excess dwell time substantially independent of temperature and manufacturing process variations.

* * * * *